US006997141B2

(12) United States Patent
Sun

(10) Patent No.: US 6,997,141 B2
(45) Date of Patent: Feb. 14, 2006

(54) ANTI-VIBRATION SUPPORT FOR STEAM GENERATOR HEAT TRANSFER TUBES AND METHOD FOR MAKING SAME

(75) Inventor: Nansheng Sun, Cambridge (CA)

(73) Assignee: Babcox & Wilcox Canada Ltd., Cambridge (CA)

( * ) Notice: Subject to any disclaimer, the term of this patent is extended or adjusted under 35 U.S.C. 154(b) by 65 days.

(21) Appl. No.: 10/695,154

(22) Filed: Oct. 28, 2003

(65) Prior Publication Data

US 2006/0005787 A1 Jan. 12, 2006

(51) Int. Cl.
*G21C 3/34* (2006.01)

(52) U.S. Cl. ..... 122/510; 376/438

(58) Field of Classification Search ..... 122/510, 122/511; 376/462; 248/68.1; 110/325; 465/162

See application file for complete search history.

(56) References Cited

U.S. PATENT DOCUMENTS 4,295,935 A * 10/1981 Anthony ..... 376/285
4,359,088 A * 11/1982 Jabsen ..... 165/172
4,640,342 A * 2/1987 Appleman ..... 165/69
4,860,697 A * 8/1989 Malaval ..... 122/510
4,917,172 A * 4/1990 Falduti ..... 165/69
5,072,786 A * 12/1991 Wachter ..... 165/69
5,130,083 A * 7/1992 Johansson ..... 376/441
5,213,155 A * 5/1993 Hahn ..... 165/162
5,570,739 A * 11/1996 Krawchuk et al. ..... 165/69
6,367,430 B1 * 4/2002 Schneider ..... 122/510
6,519,309 B1 * 2/2003 Van Swam ..... 376/442
6,650,723 B1 * 11/2003 Kang et al. ..... 376/439

* cited by examiner

*Primary Examiner*—Gregory Wilson
(74) *Attorney, Agent, or Firm*—Michael J. Seymour; Eric Marich

(57) ABSTRACT

A tube support structure for heat transfer tubes in a steam generator has a plurality of tube support bars which are installed between the heat transfer tubes. At least one of the support bars has a first metal layer and a second metal layer. The first metal layer is preferably spot welded to the second metal layer at intervals. The first metal layer and second metal layer have different thermal expansion coefficients so that at room temperature the support bar is flat, and at the operating temperature of the steam generator the first layer forms a convex shape between the intervals to support the adjacent tube.

12 Claims, 6 Drawing Sheets

ANTI-VIBRATION SUPPORT FOR STEAM GENERATOR HEAT TRANSFER TUBES AND METHOD FOR MAKING SAME

FIELD AND BACKGROUND OF INVENTION

The present invention relates generally to the field of nuclear power generation and in particular to a new and useful tube support bar for retaining and positioning water tubes within a nuclear steam generator.

Water tubes for nuclear steam generators are typically 0.5 to 0.75 inches in diameter with a nominal wall thickness of 0.045 inches. In the once-through steam generator design, the tube bundle consists of straight tubes. In a recirculating steam generator, depicted in FIG. 1, the tube bundle is made up of U-tubes.

In a pressurized water nuclear power station, steam generators, which are large heat exchangers, transfer heat, produced via nuclear reactions in the reactor core, from a primary water coolant to a secondary water coolant that drives the steam turbine. The primary coolant is pressurized, which allows the primary water coolant to be heated in the reactor core with little or no boiling. For example, in a light water reactor, the primary coolant is pressurized to about 2250 psia and heated to about 600 deg F. in the reactor core. From the reactor, the primary water coolant flows to a steam generator, where it transfers heat to the secondary coolant. In a U-tube, or recirculating steam generator, the primary coolant enters at the bottom of the steam generator, flows through tubes having an inverted U-shape transferring heat to the secondary coolant, and then exits at the bottom of the steam generator. The secondary coolant is pressurized only to a pressure below that of the primary side, and boils as it flows along the outside of the tubes, thereby producing the steam needed to drive the turbine.

Nuclear steam generators must be capable of handling large quantities of two-phase secondary coolant moving at high flow rates, and are therefore very large structures. For example, a nuclear U-tube steam generator can weigh more than 450 tons, with a diameter exceeding 12 feet and an overall length of greater than 70 feet. It may contain as many as 9,000 or more of the long, small diameter, thin-walled U-shaped tubes. For a general description of the characteristics of nuclear steam generators, the reader is referred to Chapters 47 and 52 of *Steam/Its Generation and Use,* 40th Edition, The Babcock & Wilcox Company, Barberton, Ohio, U.S.A., ©1992, the text of which is hereby incorporated by reference as though fully set forth herein.

Heat exchangers such as nuclear steam generators require tube restraints or supports, to position the tubes and to restrain the tubes against flow induced vibration forces. Tube support bars are therefore used in some nuclear steam generators is to keep the small diameter, thin wall heat transfer tubes in position and to prevent damage to the tubes due to vibration or external loads. In one tube support structure flat tube support bars are positioned at intervals along the tube bundle within the cylindrical shroud of the steam generator, forming lattice or tube support bar arrays. Each tube support bar array consists of two spaced rings that hold a latticework of crisscrossing flat bars between them. The flat bars, intersecting each other on their edges, form a diamond shape around each tube, thereby providing good vibration dampening yet allowing the steam-water mixture to flow through the tube bundle with minimal pressure drop.

One known type of lattice tube support bar array is manufactured by Babcock & Wilcox Canada Ltd. The lattice tube support bar array has a plurality of flat bars aligned parallel to one of two directions, for supporting the multiplicity of water tubes in the steam generator. When bars of different direction cross over each other, they form angles at bar intersections of 60° and 120°. Some of the bars, termed high-bars, provide most of the strength and rigidity of the array. Other smaller bars, termed low-bars, form a finer latticework that separates each tube. Low-bars comprise the majority of the bars in the array, and are about 1 inch high. Each low-bar is a unitary structure having flat sides made of a single material, typically stainless steel. High-bars, about 3 inches in height, are used about every 4 to 8 bars in the array, and have slots in their edges to permit bars arranged in the other direction to cross at the same level within a surrounding peripheral ring. The slots are typically 1 inch deep for low-bar intersections and 1½ inches deep for high-bar intersections. The high-bars are used to help position the low-bars within the array, and to transmit accumulated load to a peripheral heavy structural ring surrounding the bars. The peripheral heavy ring is connected to the outer shroud and shell of the steam generator, thereby conveying the support load to the shroud and shell.

As shown with exaggeration in FIG. 2, there is generally a gap between the heat exchanger tubes 90 and the low-bars 30, which is produced by the tolerance of the bar manufacture and is required for assembly. Similarly, gaps may exist between the heat exchanger tubes and the high-bars. Flow of steam and water past the tube induces vibrations which may not be effectively restrained due to the inherent gap. This in turn may reduce the tube life expectancy.

One known anti-vibration support is disclosed in U.S. Pat. No. 5,072,786, which describes a tube support bar design using a plurality of special hairpin springs. For a typical nuclear steam generator, this design requires the manufacture and assembly of a very, very large number of spring parts, so that it is difficult to apply the idea in practice. Therefore a new design for an anti-vibration tube support which reduces vibration, yet is easy to manufacture and install would be welcomed by industry.

SUMMARY OF INVENTION

The present invention is drawn to a new apparatus and method for eliminating the gap between tubes and their respective support tube support bars in a nuclear steam generator, whereby the tubes are disposed in the correct positions, and whereby fretting and vibration damage are substantially eliminated. The tube support bars are made of special bimetallic bars or strips. The tube support bar is made by taking a first flat elongated metallic bar and attaching it to a second flat metallic bar at specific intervals. The second flat metallic bar has a coefficient of thermal expansion greater than that of the first bar. The tube support bars are flat during manufacture and installation at a first temperature, such as room temperature. At a second, or operating temperature, higher than the first temperature, however, each support bar automatically forms a plurality of "hill-shape" springs. Such "hill-shaped" springs engage the adjacent tube, thereby eliminating the gap between the tube and its respective support. The springs are not formed at room temperature, thereby providing a suitable clearance to assure ease of installation of tubes, or, alternatively, making the support bar easy to install after the tubes are in place.

It is therefore an object of the present invention to provide a tube support bar which minimizes gaps between the tubes and the support bar.

A further object of the invention is to minimize flow induced vibration of the tubes in a steam generator, thereby extending the useful life of the tubes.

It is a still further object of the invention to provide a tube support bar which is easy to manufacture, install, or remove for replacement.

Accordingly, an improved tube support structure is provided for use within an array of generally parallel heat exchanger tubes. The tube support structure has a tube support bar for use in operation between a pair of tubes. The bar is made of a first metallic strip attached to a second metallic strip at spaced intervals. The first strip has a coefficient of thermal expansion greater than the second strip. At a first temperature, the first and second strips are flat. At a second temperature higher than the first temperature, the first strip takes on a convex shape.

In another embodiment, a support for heat transfer tubes in a steam generator is provided. The support includes a plurality of bars installed between the heat transfer tubes so that a gap exists between the bars and the heat transfer tubes. Spring means are welded to at least one of the bars at intervals, with the spring means having a thinner thickness than the bar. The spring means and the bar have different thermal expansion coefficients so that at a non-operating temperature of the steam generator the spring means does not contact the adjacent tube and at the operating temperature of the steam generator the spring means contacts the adjacent heat tube.

In yet another embodiment, a method is provided for making a tube support bar for supporting heat transfer tubes in a steam generator. A first metal layer is welded to a second metal layer at intervals to form a support bar. The first metal layer and the second metal layer have different thermal expansion coefficients so that at a non-operating temperature of the steam generator the bar is flat, and at the operating temperature of the steam generator the first layer forms a convex shape between the intervals. Several support bars are installed in the steam generator so that a gap exists between the tubes and the support bars.

The various features of novelty which characterize the invention are pointed out with particularity in the claims annexed to and forming part of this disclosure. For a better understanding of the present invention, and the operating advantages attained by its use, reference is made to the accompanying drawings and descriptive matter, forming a part of this disclosure, in which a preferred embodiment of the invention is illustrated.

BRIEF DESCRIPTION OF THE DRAWINGS

In the accompanying drawings, forming a part of this specification, and in which reference numerals shown in the drawings designate like or corresponding parts throughout the same.

DESCRIPTION OF THE PREFERRED EMBODIMENTS

Figure 1:
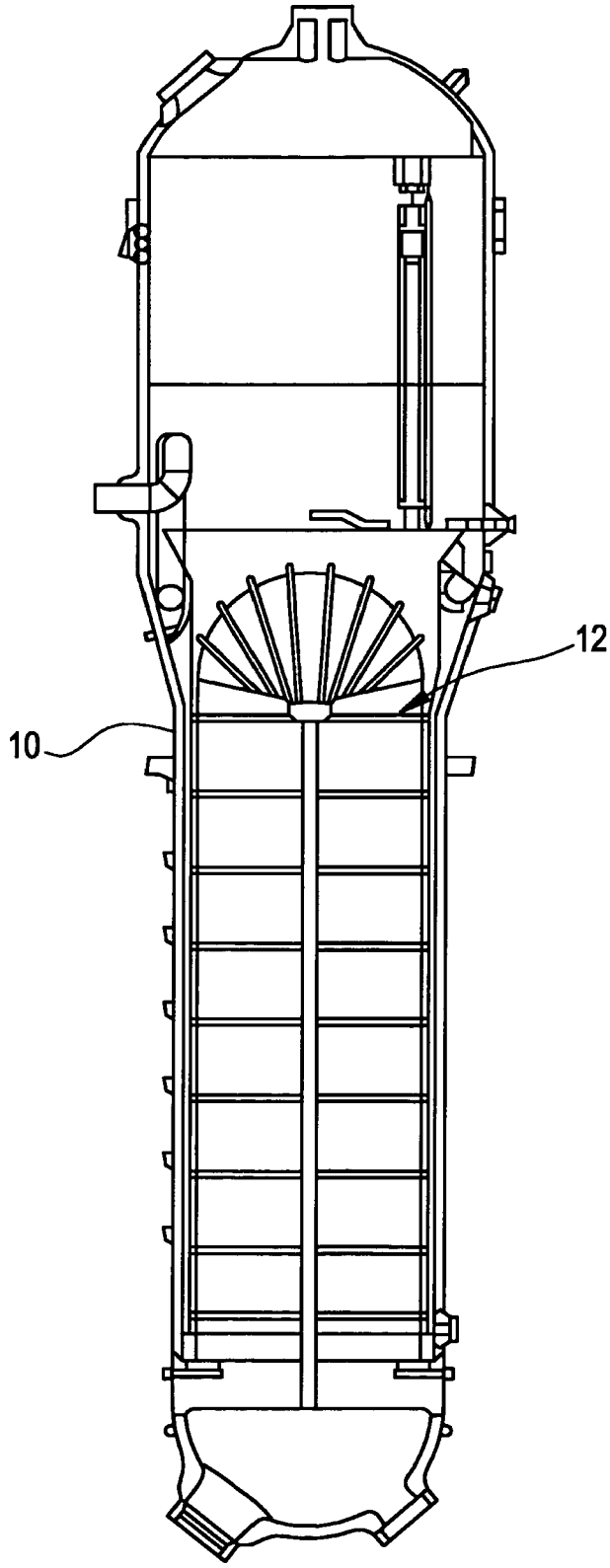
FIG. 1 PRIOR ART
FIG. 1 is a sectional front elevational view of a nuclear steam generator where tube support bars of the invention are used.
Figure 2:
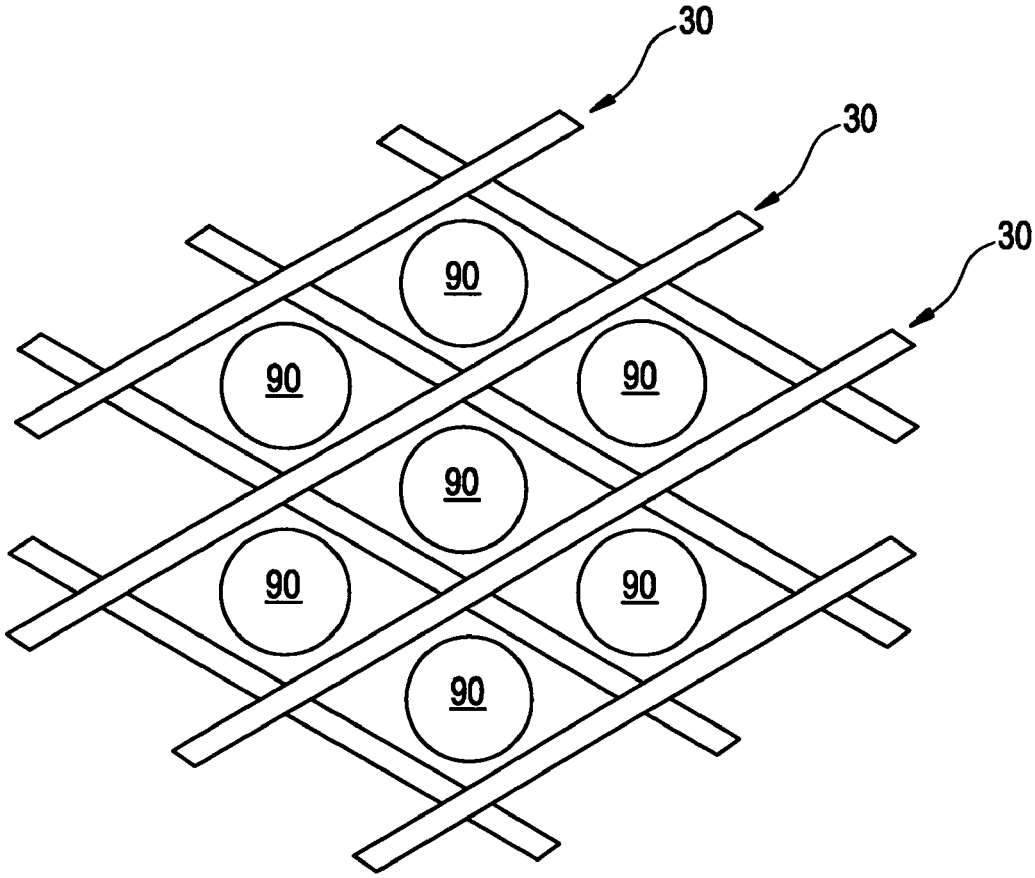
FIG. 2 PRIOR ART
FIG. 2 is a top plan view of a section of a known tube support bar array.

Referring now to the drawings, in which like reference numerals are used to refer to the same or functionally similar elements, FIG. 1 shows a nuclear steam generator 10 having a series of tube support bar arrays 12 at various points along its height for supporting a plurality of water tubes within the steam generator.

Figure 3:
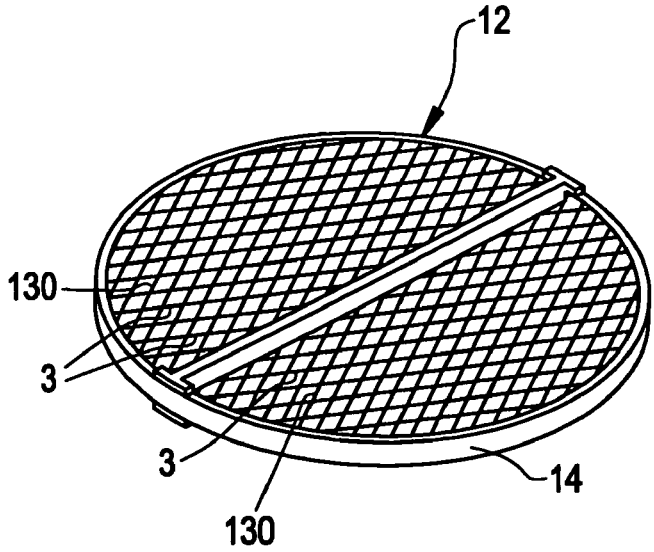
FIG. 3 is a perspective view of a tube bar support array using tube support bars of the invention.
Figure 4:
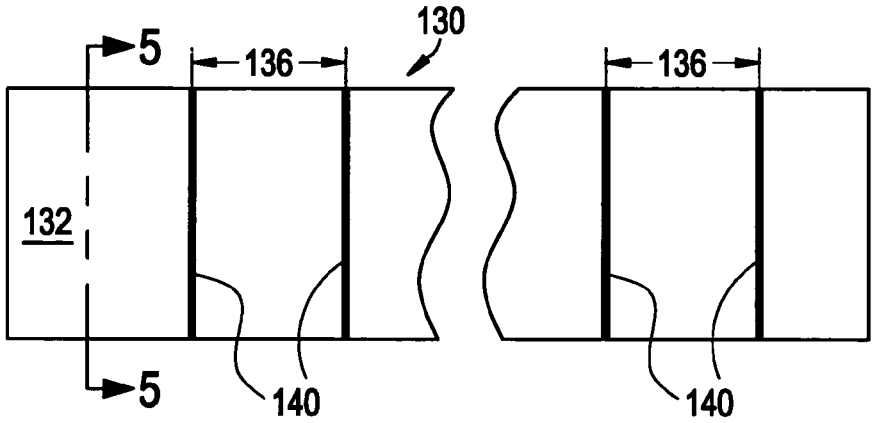
FIG. 4 is a side view of a tube support bar according to the present invention.
Figure 5:
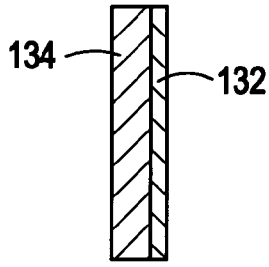
FIG. 5 is a cross-sectional view taken along line 5—5 of FIG. 4 of a tube support bar according to the present invention.

The tube support bar arrays 12 have a peripheral ring 14 supporting a series of high- and low-bars 3, 130, respectively, as shown in FIG. 3. The high- and low-bars 3, 130 are arranged parallel to one of two directions, with intersection angles of 60° and 120° where bars 3, 130 oriented in different directions cross each other.

Figure 6:
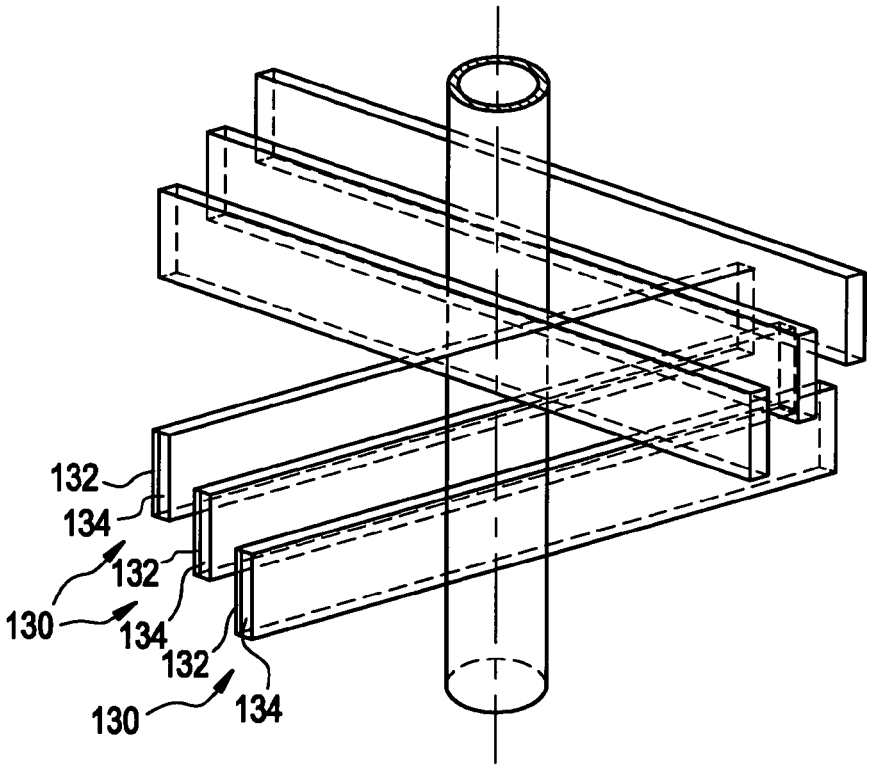
FIG. 6 is a partial perspective view showing a plurality of tube support bars according to the present invention.
Figure 7:
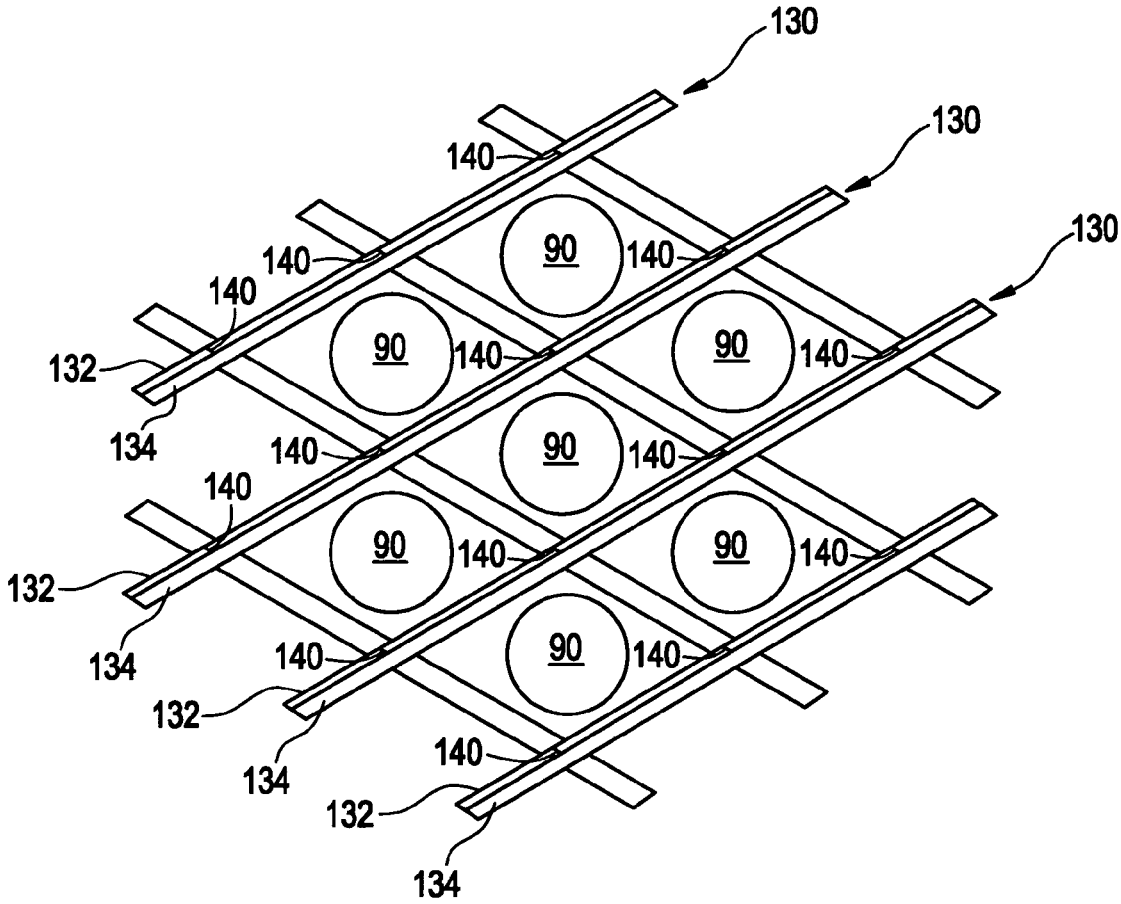
FIG. 7 is a partial top view showing a tube support bar array according to the present invention just after installation.
Figure 8:
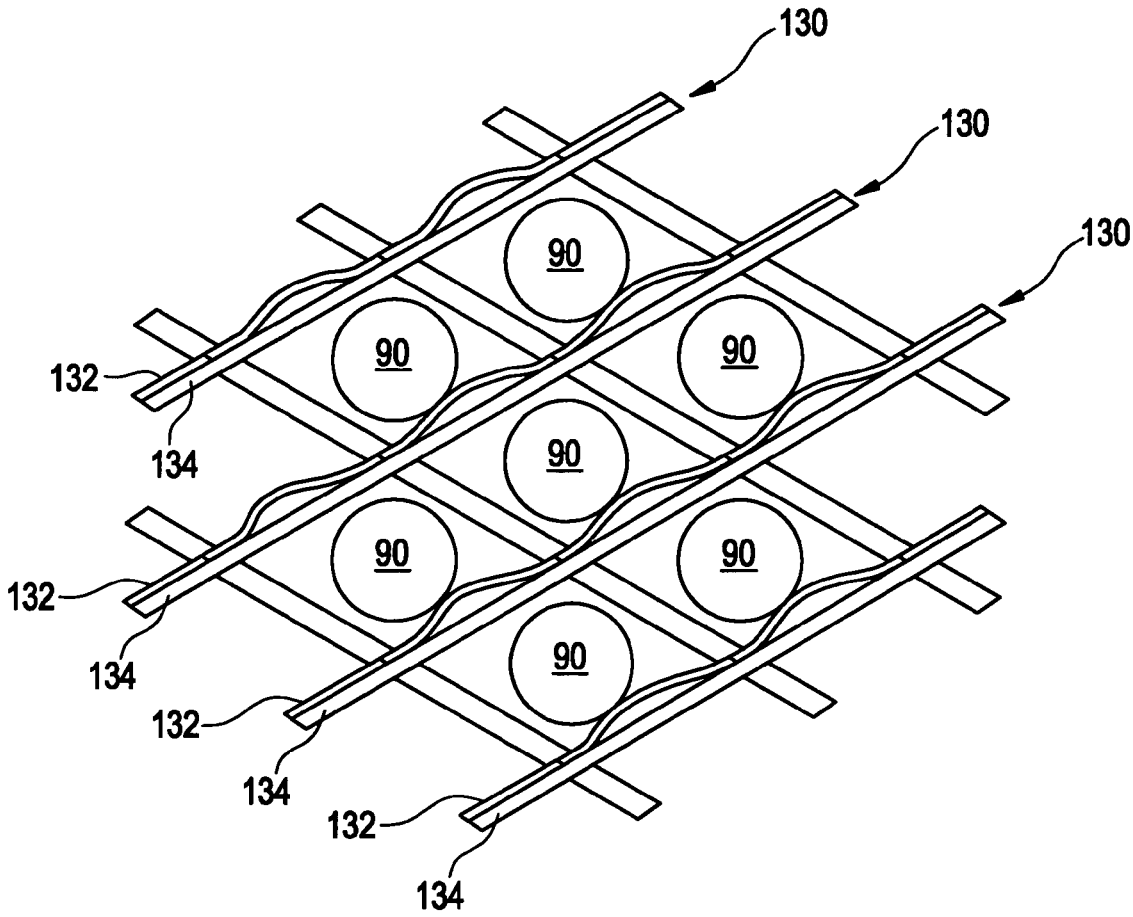
FIG. 8 is a partial top view showing a tube support bar array according to the present invention in operation.

Referring to FIGS. 4–8, according to the subject invention, low-bar 130 is made of a relatively thin, preferably continuous, first strip or bar 132 secured to a relatively thick, preferably continuous, second strip or bar 134 via attachment 140. Attachment 140 is preferably made at uniformly spaced intervals 136 along and transverse to the length of low-bar 130. First strip 132 is selected to have a coefficient of thermal expansion which is higher than that of the second strip. As shown in FIGS. 6 and 7, at a given temperature, typically room temperature or standard temperature, both strips 132 and 134 are flat, making it easy to insert heat exchanger tubes 90 within bars 130, or, alternatively, to insert bars 130 between rows of tubes 90. At higher temperatures the greater thermal expansion of the first strip causes it to take on a convex shape, as shown in FIG. 8.

The following example is provided for the purpose of further illustrating the invention, but is in no way to be taken as limiting.

Figure 9:
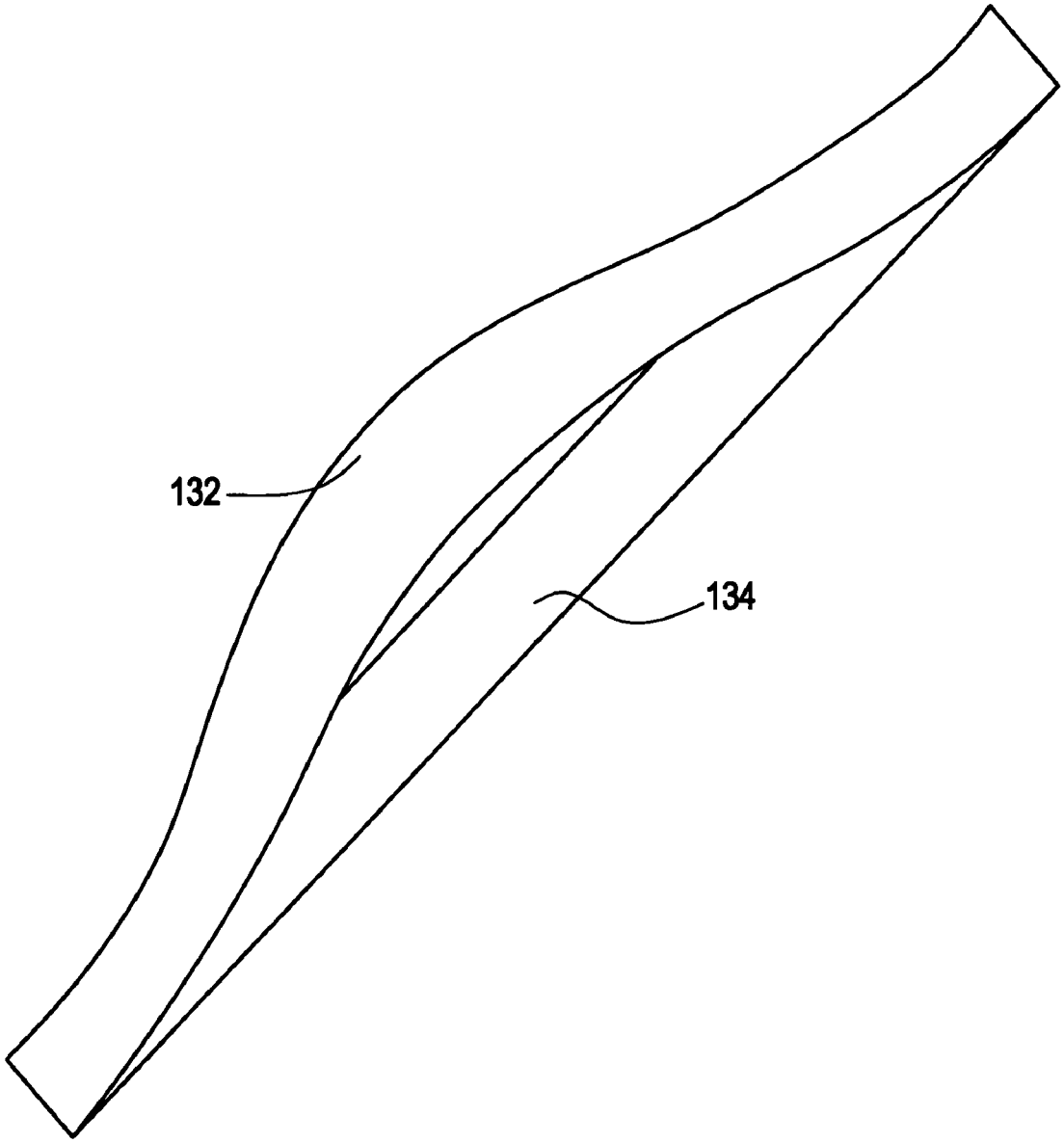
FIG. 9 is an partial perspective view showing a portion of a tube support bar in its expanded state during operation.

For an application in a nuclear steam generator, low-bar 130 preferably has height of 1". Low-bar 130 is comprised of a relatively thick strip 134 that is 0.08" thick and made of SA 240 type 410S, a known bar material, and a relatively thin strip 132 that is 0.02" thick and made of SB-166 1690, a nickel alloy. Thin strip 132 is spot-welded on the thick strip 134 at intervals 136 of about 1", or about 2 tube diameters plus tolerance. When the nuclear steam generator is heated to its operating temperature (e.g. about 550 deg. F.), the different thermal expansion coefficients of these two metals (6.51E-06 per deg. F. and 8.13 E-06 per deg. F., respectively) produce a cyclic convex hill shape along the bar 130. Non-linear buckling finite element analysis predicts that the thermal compression stress within the thin strip 132 produces a deformed, convex hill shape as shown in FIG. 9. It is worth noting that only the thin strip 132 is buckled, while thick strip 134 remains straight. Each convex hill shape forms a spring, thereby eliminating the gap between heat exchanger tube 90 and bar 130. This eliminates or reduces flow-induced vibration and fretting, thus increasing tube life expectancy.

The improved tube support bars 130 are simple to manufacture and can be made in a regular shop environment. As an added advantage, improved tube support bars 130 can be used without affecting existing steam generator assembly techniques.

While specific embodiments and/or details of the invention have been shown and described above to illustrate the application of the principles of the invention, it is understood that this invention may be embodied as more fully described in the claims, or as otherwise known by those skilled in the art (including any and all equivalents), without departing from such principles. As one example, a thin strip 132 could be welded on both sides of thick strip 134 thereby forming a convex hill shape on each side of thick strip 134 when heated to its operating temperature. As another example, the invention could also be applied to the high-bars 3 of a lattice support bar array. The invention could also be applied in retrofit applications, e.g. as an auxiliary anti-vibration bar, and may also be suitable for use in the U-bend region of a recirculating steam generator.

I claim:

1. A tube support structure for use within an array of heat exchanger tubes, each tube having a diameter and a longitudinal axis, the tube support structure comprising:

a tube support bar for use between a pair of heat exchanger tubes, the support bar comprised of a first metallic strip attached to a second metallic strip at spaced intervals, the first strip having a coefficient of thermal expansion greater than the second strip, wherein the first strip is attached to the second strip at spaced intervals in a direction transverse to the length of the second strip, and wherein the first strip is attached to the second strip at spaced intervals of about 2 tube diameters.

2. The tube support structure of claim 1, wherein the first and second strips are flat at a first temperature, and wherein the first strip becomes convex at a temperature higher than the first temperature.

3. The tube support structure of claim 1, wherein the first strip is thinner than the second strip.

4. The tube support structure of claim 3, wherein the first strip is 0.02 inches thick and the second strip is 0.08 inches thick.

5. The tube support structure of claim 1, wherein the first strip is attached to the second strip via spot welding.

6. The tube support structure of claim 1, wherein the tube diameter is about 0.5 inches and the first strip is attached to the second strip at spaced intervals of about 1 inch.

7. The tube support structure of claim 1, wherein the first strip is made of SB-166 1690 and the second strip is made of SA 240 type 410S.

8. The tube support structure of claim 1, wherein said tube support structure is operational at a temperature of about 550 degrees F.

9. The tube support structure of claim 1, wherein the tube support bar is a low-bar of a lattice tube support bar array.

10. The tube support structure of claim 1, wherein the tube support bar is a high-bar of a lattice tube support bar array.

11. A tube support structure for use within an array of heat exchanger tubes, each tube having a diameter and a longitudinal axis, the tube support structure comprising:

a tube support bar for use between a pair of heat exchanger tubes, the support bar comprised of a first metallic strip attached to a second metallic strip at spaced intervals, the first strip having a coefficient of thermal expansion greater then the second strip, a third metallic strip attached to the second metallic strip opposite the first metallic strip at spaced intervals, the third strip having a coefficient of thermal expansion greater than the second strip.

12. A support for heat transfer tubes in a steam generator, the support comprising:

a plurality of bars installed between the heat transfer tubes so that a gap exists between the bars and the heat transfer tubes;

a spring means welded to at least one of the bars at intervals, the spring means having a thinner thickness than the bar; and wherein the spring means and the bar have different thermal expansion coefficients so that at a non-operating temperature of the steam generator the spring means does not contact the adjacent tube and at the operating temperature of the steam generator the spring means contacts the adjacent heat transfer tube.

* * * * *